US009041750B2

(12) United States Patent
Dai et al.

(10) Patent No.: US 9,041,750 B2
(45) Date of Patent: May 26, 2015

(54) DRIVING CIRCUIT OF LCD PANEL, LCD DEVICE, AND METHOD FOR DRIVING THE LIQUID CRYSTAL PANEL

(71) Applicant: SHENZHEN CHINA STAR OPTOELECTRONICS TECHNOLOGY CO., LTD., Shenzhen (CN)

(72) Inventors: Ye Dai, Shenzhen (CN); Chih tsung Kang, Shenzhen (CN)

( * ) Notice: Subject to any disclaimer, the term of this patent is extended or adjusted under 35 U.S.C. 154(b) by 65 days.

(21) Appl. No.: 14/113,215

(22) PCT Filed: Jun. 28, 2013

(86) PCT No.: PCT/CN2013/078276

§ 371 (c)(1),
(2) Date: Oct. 21, 2013

(87) PCT Pub. No.: WO2014/166170

PCT Pub. Date: Oct. 16, 2014

(65) Prior Publication Data

US 2014/0300650 A1 Oct. 9, 2014

(51) Int. Cl.
*G09G 3/36* (2006.01)

(52) U.S. Cl.
CPC ..... *G09G 3/3611* (2013.01); *G09G 2320/0252* (2013.01); *G09G 2320/0285* (2013.01); *G09G 2340/16* (2013.01); *G09G 2360/16* (2013.01)

(58) Field of Classification Search
CPC ..... G09G 3/3611; G09G 2320/0252; G09G 2360/16; G09G 2340/16; G09G 2320/0285
USPC ..... 345/89, 690
See application file for complete search history.

(56) References Cited

U.S. PATENT DOCUMENTS

| | | | | |
|---|---|---|---|---|
| 7,705,816 | B2 | 4/2010 | Chen et al. | |
| 2003/0179175 | A1 | 9/2003 | Shigeta et al. | |
| 2006/0152535 | A1 * | 7/2006 | Huang et al. | 345/690 |
| 2006/0274162 | A1 * | 12/2006 | Fujishiro | 348/229.1 |
| 2007/0075951 | A1 * | 4/2007 | Lin et al. | 345/89 |
| 2012/0092387 | A1 | 4/2012 | Yang et al. | |

FOREIGN PATENT DOCUMENTS

| | | | |
|---|---|---|---|
| CN | 1691121 | A | 11/2005 |
| CN | 1776802 | A | 5/2006 |
| CN | 1828713 | A | 9/2006 |
| CN | 101359458 | A | 2/2009 |
| CN | 101364386 | A | 2/2009 |
| CN | 101409051 | A | 4/2009 |
| CN | 101425267 | A | 5/2009 |
| JP | 2007219392 | A | 8/2007 |

* cited by examiner

*Primary Examiner* — Premal Patel

(57) ABSTRACT

A method for driving a liquid crystal display (LCD) panel includes: A: setting an M*M over drive (OD) table, the M*M OD table includes a grey scale value XN*a of a previous-frame image, a grey scale value XN*b of a current-frame image, and an OD value (XN*a, XN*b) corresponding to the grey scale value XN*a and the grey scale value XN*b, where a and b∈[0, M], N and M are integers, and N>=2. B: regarding x' as the grey scale value of the previous-frame image and y' as the grey scale value of the current-frame image when the LCD panel is driven, the OD value (x', y') is fitted to a continuous two-dimensional surface by reference to an OD value (XN*a, XN*b) in the OD table, and the OD value (x', y') is correspondingly calculated according to function of the two-dimensional surface fitted and is output to the LCD panel.

20 Claims, 4 Drawing Sheets

DRIVING CIRCUIT OF LCD PANEL, LCD DEVICE, AND METHOD FOR DRIVING THE LIQUID CRYSTAL PANEL

TECHNICAL FIELD

The present disclosure relates to the field of liquid crystal displays (LCDs), and more particularly to a driving circuit of an LCD panel, an LCD device, and a method for driving the LCD panel.

BACKGROUND

Over drive (OD) is an important technology and is used to improve dynamic picture quality of a liquid crystal display (LCD) panel. Working principle of the OD is that a signal C is inserted between a signal A and a signal B when the signal A changes to the signal B, and LC molecules are driven to quickly deflect by a voltage difference between the signal A and the signal C. When one frame time of the signal C ends, a deflection angle of the LC molecules exactly accords with an angle requirement of the signal B. In a driving circuit of an LCD, a grey scale corresponds to a voltage of a signal, and the LCD panel automatically looks up a corresponding voltage of the signal C according to grey scale values of the signal A and the signal B. Most LCD panels currently use a color depth of 8-bit, and the signal A and the signal B have 256 grey scales, so capacity of an OD table is 256*256*8-bit (the 8-bit is storage space of the voltage of the signal C). If an OD table of a red pixel, an OD table of a green pixel, and an OD table of a blue pixel are different, the capacity of the OD table is 3*256*256*8-bit.

In most LCD driving circuits, space of a read-only memory (ROM) storing the OD table is not large, thus, an OD table of 17*17*8-bit is used. As shown in FIG. 1, in the OD table, the corresponding voltage of the signal C is added according to a grey scale value of the signal A and a grey scale value of the signal B, the grey scale values of the signal A is obtained from each of the 16 grey scales of the grey scale values of the signal A, and the grey scale value of the signal B is obtained from each of the 16 grey scales of the grey scale values of the signal B. An OD value of grey scales among each 16 grey scales is calculated by linear interpolation according to surrounding four voltages of the signal C, an equation of calculating the OD value is:

$$Cmn = C_{99} + \frac{M-208}{16} * (C_{100} - C_{99}) + \frac{N-176}{16} * \left[\left(C_{82} + \frac{M-208}{16} * (C_{83} - C_{82})\right) - \left(C_{99} + \frac{M-208}{16} * (C_{100} - C_{99})\right)\right]$$

The above-mentioned method solves a problem of the storage of the OD table, but linear interpolation is not accurate, thus the OD table is also not accurate, which causes colored trailing of the dynamic picture.

SUMMARY

In view of the above-described problems, the aim of the present disclosure is to provide a driving circuit of a liquid crystal display (LCD) panel, a liquid crystal display (LCD) device, and a method for driving the LCD panel capable of using a small storage space for an over drive (OD) table and avoiding colored trailing of a dynamic picture.

The purpose of the present disclosure is achieved by the following methods:

A method for driving a liquid crystal display (LCD) panel comprises

A: setting an M*M over drive (OD) table by regarding N grey scales as one unit, the M*M OD table comprises a grey scale value XN*a of a previous-frame image, a grey scale value XN*b of a current-frame image, and an OD value (XN*a, XN*b) corresponding to the grey scale value XN*a and the grey scale value XN*b, where a and b∈[0, M], N and M are integers, and N>=2;

B: regarding x' as the grey scale value of the previous-frame image and y' as the grey scale value of the current-frame image when the LCD panel is driven, and finding out an effective OD value (x', y') from the OD table. If x' is equal to XN*a, and y' is equal to XN*b, the effective OD value (x', y') is directly found out from the OD table; if x' is not equal to XN*a, and y' is not equal to XN*b, a three-dimensional coordinate system is set according to coordinate axis of x', y', and the OD value (x', y'); the OD value (x', y') is fitted to a continuous two-dimensional surface by reference to the OD value (XN*a, XN*b) in the OD table, and the OD value (x', y') is correspondingly calculated according to function of the two-dimensional surface fitted; and C: outputting the OD value (x', y') to the LCD panel after the previous-frame image is output but before the current frame image is output.

Furthermore, the two-dimensional surface in the step B is divided into M*M sub-surfaces, and first derivatives of junctional areas of all sub-surfaces are continuous. The function of the two-dimensional surface fitted in the step B is formed by a sub-surface equation corresponding to each of the sub-surfaces.

The sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \tag{1}$$

A boundary condition corresponding to each of the sub-surfaces is:

$$OD(0, 0) = C_h \tag{2}$$

$$OD(0, N) = C_i \tag{3}$$

$$OD(N, 0) = C_j \tag{4}$$

$$OD(N, N) = C_k \tag{5}$$

$$\frac{dOD(0, 0)}{dx} = \frac{C_i - C_h}{16} \tag{6}$$

$$\frac{dOD(0, 0)}{dy} = \frac{C_j - C_h}{16} \tag{7}$$

$$\frac{dOD(0, 16)}{dx} = \begin{cases} 0, & \text{The sub-surface lies in a right boundary of the two-dimensional surface} \\ \frac{C_1 - C_i}{16}, & \text{The sub-surface does not lie in a boundary of the two-dimensional surface} \end{cases} \tag{8}$$

$$\frac{dOD(0, 16)}{dy} = \frac{C_k - C_i}{16} \tag{9}$$

$$\frac{dOD(16, 0)}{dx} = \frac{C_k - C_j}{16} \tag{10}$$

-continued $$\frac{dOD(16,0)}{dy}=\begin{cases}0, & \text{The sub-surface lies in an upper boundary of the two-dimensional surface}\\ \frac{C_m-C_k}{16}, & \text{The sub-surface does not lie in the boundary of the two-dimensional surface}\end{cases} \quad (11)$$

In the above-mentioned equation:

1) x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface.

2) A, B, C, D, E, F, G, H, I, and J are constant parameters of each of the surfaces, wherein each of the constant parameters is calculated according to the boundary condition of the corresponding sub-surface.

3) Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right.

If a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

This is a specific function of the two-dimensional surface. The two-dimensional surface is divided into a plurality of sub-surfaces, and the first derivatives of junctional areas of all sub-surfaces is continuous, thus reading the grey scale value x' of the previous-frame image and the grey scale value y' of the current-frame image, and after finding out the grey scale coordinate (x, y) of the grey scale value x' and the grey scale value y' which correspond to the sub-surface, the OD value (x', y') can be calculated according to the equation of the sub-surface and the boundary condition of the sub-surface where the OD value (x', y') accurately corresponds to the grey scale value (x', y').

Furthermore, the step B comprises:

B1-1: reading the grey scale value x' of the previous-frame image and the grey scale value y' of the current-frame image;

B1-2: looking up a grey scale coordinate (x, y) of the grey scale value x' and the grey scale value y' that correspond to the sub-surface;

B1-3: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table; and B1-4: calculating the OD value (x, y) according to the equations of (1)-(11);

$$x'=x+N*a,\ y'=y+N*b,\ \text{and } a \text{ and } b\in[0,M].$$

In the method, the driving circuit of the LCD panel only stores the OD table corresponding to the boundary of each of the sub-surfaces and does not store the OD value corresponding to each of the sub-surfaces, which lowers storage space requirements and decreases component costs.

Furthermore, the step B comprises:

B2-1: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table;

B2-2: calculating the constant parameter of the equation (1) of each of the sub-surfaces by substituting the OD value Ch, Ci, Cj, Ck, Cl, and Cm into the equation (2)-(11) of the boundary condition of each of the sub-surfaces, and storing the constant parameters into a constant parameter table;

B2-3: reading the grey scale value x' of the previous-frame image and the grey scale value y' of the current-frame image, and looking up the grey scale coordinate (x, y) of the grey scale value x' and the grey scale value y' that correspond to the sub-surface; and B2-4: calculating the OD value (x, y) according to the equations of (1) of the current sub-surface, wherein the grey scale coordinate (x, y) and the corresponding constant parameter are substituted into the equation (1);

$$x'=x+N*a,\ y'=y+N*b,\ \text{and } a \text{ and } b\in[0,M].$$

In the method, the constant parameter of the equation of each of the sub-surfaces is calculated in advance and stored in the driving circuit, when the LCD panel is driven, as long as the equation of the sub-surface corresponding to the grey scale value can be determined, the OD value (x', y') can be calculated by directly substituting the grey scale coordinate (x, y) into the equation of the sub-surface, which avoids calculation of the constant parameter, thereby improving response speed of the driving circuit and improves display quality of the LCD panel.

Furthermore, M is equal to 17, and N is equal to 16. This is a specific value of M and N, brightness of the display picture is divided into 256 grey scales, and each of the 16 grey scales is regarded as one unit.

A driving circuit of a liquid crystal display (LCD) panel comprises a frame buffer unit storing a previous-frame image, an over drive (OD) table unit storing an M*M OD table set through regarding N grey scales as one unit, and a calculation unit coupled to the OD table unit. The M*M OD table comprises a grey scale value XN*a of the previous-frame image, a grey scale value XN*b of a current-frame image, and an OD value (XN*a, XN*b) corresponding to the grey scale value XN*a and the grey scale value XN*b, where a and b∈[0, M], N and M are integers, and N>=2. A grey scale value y' of the current-frame image and a grey scale value x' of the previous-frame image stored in the frame buffer unit are sent to the calculation unit, the calculation unit finds out an effective OD value (x', y') from the OD table, then the effective OD value (x', y') is output to a corresponding data line of the LCD panel.

If x' is equal to XN*a, and y' is equal to XN*b, the effective OD value (x', y') is directly found out from the OD table.

If x' is not equal to XN*a, and y' is not equal to XN*b, a three-dimensional coordinate system is set according to coordinate axis of x', y', and the OD value (x', y'). The OD value (x', y') is fitted to a continuous two-dimensional surface by reference to the OD value (XN*a, XN*b) in the OD table, and the OD value (x', y') is correspondingly calculated according to function of the two-dimensional surface fitted.

Furthermore, the calculation unit comprises a surface generating unit, a limited unit storing a boundary condition of each of the sub-surfaces, and an arithmetic unit obtaining the OD value (x', y') by calculating the equation of each of the sub-surfaces. The surface generating unit divides the two-dimensional surface into M*M sub-surfaces, and allows first derivatives of junctional areas of all sub-surfaces to be continuous.

The sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \quad (1)$$

The boundary condition corresponding to each of the sub-surfaces is:

$$OD(0,0)=C_h \quad (2)$$

$$OD(0,N)=C_i \quad (3)$$

$$OD(N,0)=C_j \quad (4)$$

$$OD(N,N)=C_k \quad (5)$$

$$\frac{dOD(0,0)}{dx}=\frac{C_i-C_h}{16} \quad (6)$$

$$\frac{dOD(0,0)}{dy}=\frac{C_j-C_h}{16} \quad (7)$$

$$\frac{dOD(0,16)}{dx}=\begin{cases}0, & \text{The sub-surface lies in a right boundary of the two-dimensional surface}\\ \frac{C_1-C_i}{16}, & \text{The sub-surface does not lie in a boundary of the two-dimensional surface}\end{cases} \quad (8)$$

$$\frac{dOD(0,16)}{dy}=\frac{C_k-C_i}{16} \quad (9)$$

$$\frac{dOD(16,0)}{dx}=\frac{C_k-C_j}{16} \quad (10)$$

$$\frac{dOD(16,0)}{dy}=\begin{cases}0, & \text{The sub-surface lies in an upper boundary of the two-dimensional surface}\\ \frac{C_m-C_k}{16}, & \text{The sub-surface does not lie in the boundary of the two-dimensional surface}\end{cases} \quad (11)$$

In the above-mentioned equation:

1) x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface.

2) A, B, C, D, E, F, G, H, I, and J are constant parameters of each of the surfaces, wherein each of the constant parameters is calculated according to the boundary condition of the corresponding sub-surface.

3) Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right.

If a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

This is a specific function of the two-dimensional surface. The two-dimensional surface is divided into a plurality of sub-surfaces, and the first derivatives of junctional areas of all sub-surfaces is continuous, thereby reading the grey scale value x' of the previous-frame image and the grey scale value y' of the current-frame image, and finding out the grey scale coordinate (x, y) of the grey scale value x' and the grey scale value y' that correspond to the sub-surface, the OD value (x', y') can be calculated according to the equation of the sub-surface and the boundary condition of the sub-surface where the OD value (x', y') accurately corresponds to the grey scale value (x', y'). The driving circuit only stores the OD value corresponding to the boundary of each of the sub-surfaces and does not store the OD value corresponding to each of the sub-surfaces, which lowers storage space requirements and decreases component costs.

Furthermore, the driving circuit of the LCD panel further comprises a parameter unit, where the parameter unit is coupled to the calculation unit, and stores a constant parameter table of the equation of each of the sub-surfaces. In the method, the constant parameter of the equation of each of the sub-surfaces is calculated in advance and stored in the driving circuit, when the LCD panel is driven, as long as the equation of the sub-surface corresponding to the grey scale value can be determined, the OD value (x', y') can be calculated by directly substituting the grey scale coordinate (x, y) into the equation of the sub-surface, which avoids calculation of the constant parameter, thereby improving response speed of the driving circuit and improves display quality of the LCD panel.

Furthermore, the driving circuit of the LCD panel further comprises a data comparator. The frame buffer unit is coupled to the calculation unit through the data comparator, and the grey scale value x' of the previous-frame image and the grey scale value y' of the current-frame image are sent to the calculation unit by the data comparator. In the present disclosure, the data comparator extracts the grey scale values of the previous-frame image and the current-frame image, and sends the grey scale values of the previous-frame image and the current-frame image to the calculation unit, the calculation unit directly reads the grey scale values and substitutes the grey scale values into the equation of the sub-face, which improves calculating speed of the calculation unit.

A liquid crystal display (LCD) device comprises a liquid crystal display (LCD) panel comprising a plurality of data lines, the plurality of data lines are coupled to the above-mentioned driving circuit of the LCD panel.

The present disclosure builds the M*M OD table by regarding N grey scales as one unit, the M*M OD table comprises the grey scale value XN*a of the previous-frame image, the grey scale value XN*b of the current-frame image, and the OD value (XN*a, XN*b) corresponding to the grey scale value XN*a and the grey scale value XN*b, where N>=2. Compared with a method of the OD value corresponding to each of the grey scales, the present disclosure lowers storage space requirements. Additionally, in the present disclosure, the OD value (x', y') is fitted to the continuous two-dimensional surface by reference to the OD value (XN*a, XN*b) in the OD table, thus the exact OD value (x', y') is calculated by each of the grey scale coordinate (x', y') according to the function of the two-dimensional surface fitted, which avoids a colored trailing of dynamic picture.

DETAILED DESCRIPTION

Figure 1:
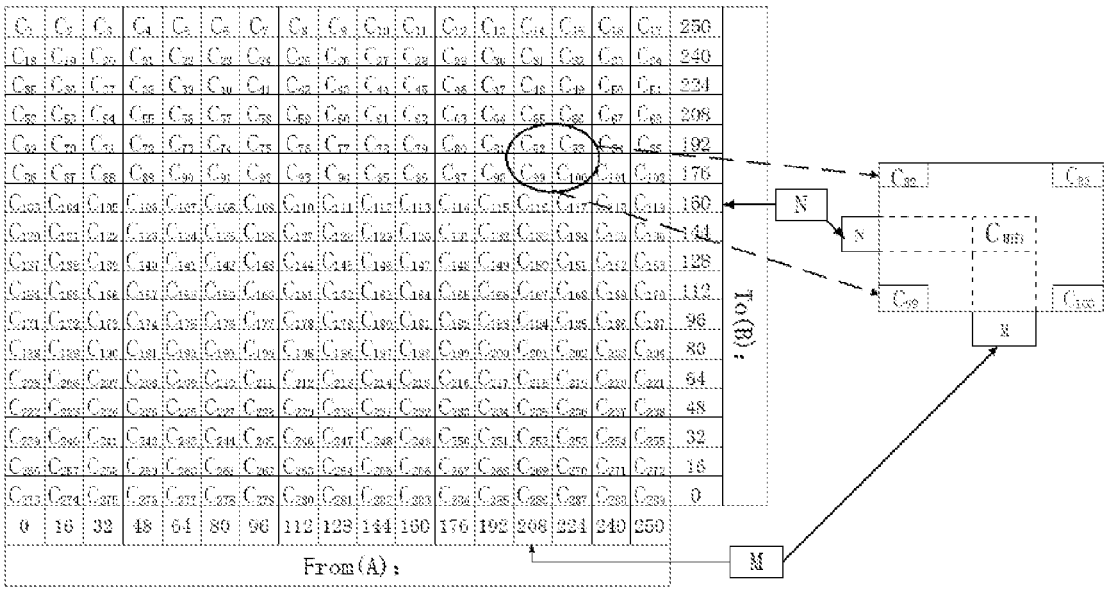
FIG. 1 (PRIOR ART)
FIG. 1 is a diagram of a method for calculating an over drive (OD) value of the prior art.
Figure 2:
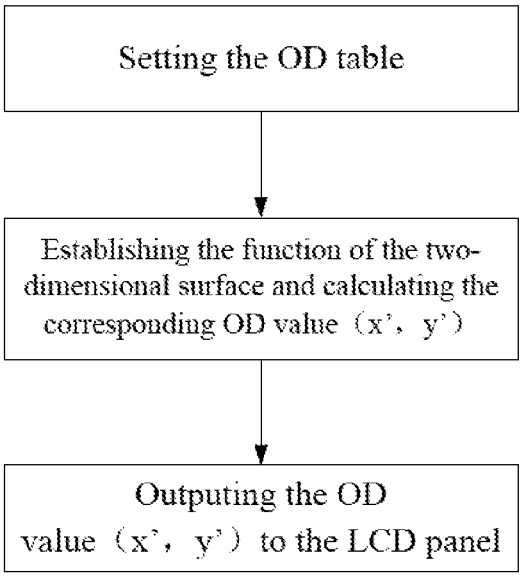
FIG. 2 is a flowchart of a method for driving a liquid crystal display (LCD) panel of the present disclosure.

As shown in FIG. 2, the present disclosure provides a method for driving a liquid crystal display (LCD) panel, comprising:

A: setting an M*M over drive (OD) table by regarding N grey scales as one unit, the M*M OD table comprises a grey scale value XN*a of a previous-frame image, a grey scale value XN*b of a current-frame image, and an OD value (XN*a, XN*b) corresponding to the grey scale value XN*a and the grey scale value XN*b, where a and b∈[0, M], N and M are integers, and N>=2.

B: regarding x' as the grey scale value of the previous-frame image and y' as the grey scale value of the current-frame image when the LCD panel is driven, and finding out an effective OD value (x', y') from the OD table. If x' is equal to XN*a, and y' is equal to XN*b, the effective OD value (x', y') is directly found out from the OD table. If x' is not equal to XN*a, and y' is not equal to XN*b, a three-dimensional coordinate system is set according to coordinate axis of x', y', and the OD value (x', y'). The OD value (x', y') is fitted to a continuous two-dimensional surface by reference to the OD value (XN*a, XN*b) in the OD table, and the OD value (x', y') is correspondingly calculated according to function of the two-dimensional surface fitted, C: outputting the OD value (x', y') to the LCD panel after the previous-frame image is output but before the current frame image is output.

The present disclosure sets the M*M OD table by regarding N grey scales as one unit, the M*M OD table comprises the grey scale value XN*a of the previous-frame image, the grey scale value XN*b of the current-frame image, and the OD value (XN*a, XN*b) corresponding to the grey scale value XN*a and the grey scale value XN*b, where N>=2. Compared with a method of the OD value corresponding to each of the grey scales, the present disclosure lowers storage space requirements. Additionally, in the present disclosure, the OD value (x', y') is fitted to the continuous two-dimensional surface by reference to the OD value (XN*a, XN*b) in the OD table, thus an exact OD value (x', y') is calculated by each of the grey scale coordinate (x', y') according to the function of the two-dimensional surface fitted, which avoids colored trailing of a dynamic picture.

The present disclosure is further described in detail in accordance with the figures and the exemplary examples.

Example 1

Figure 3:
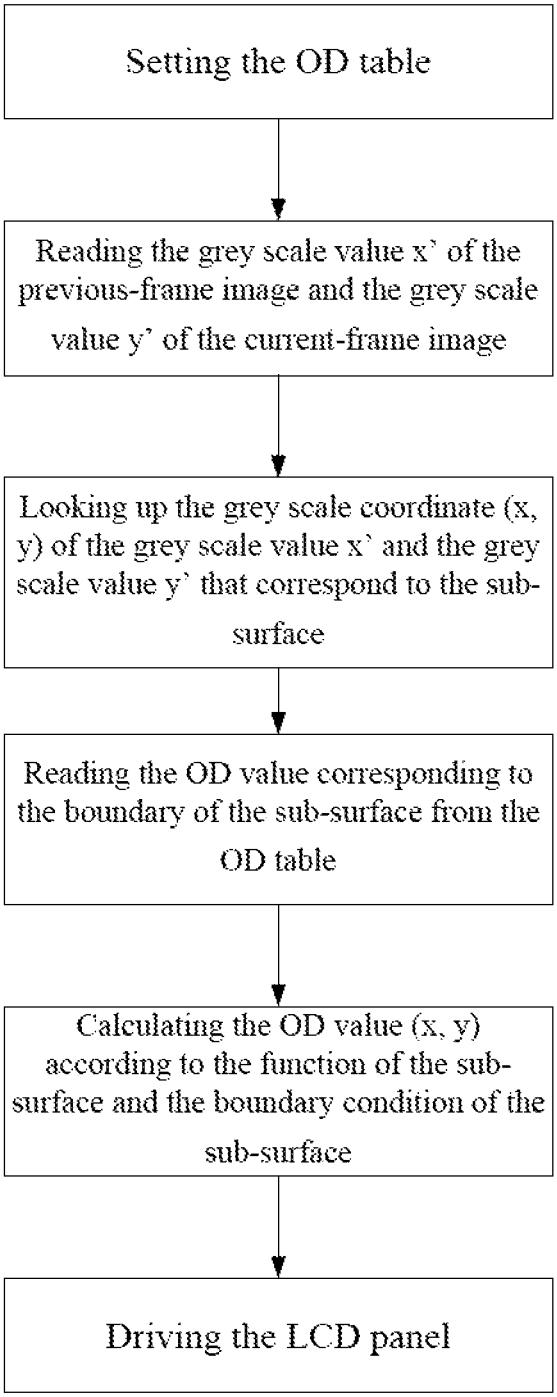
FIG. 3 is a flowchart of a method for driving a liquid crystal display (LCD) panel of a first example of the present disclosure.

As shown in FIG. 3, a first example provides a method for driving the LCD panel, comprises:

A: setting the M*M over drive (OD) table by regarding N grey scales as one unit, the M*M OD table comprises the grey scale value XN*a of the previous-frame image, the grey scale value XN*b of the current-frame image, and the OD value (XN*a, XN*b) corresponding to the grey scale value XN*a and the grey scale value XN*b, where a and b∈[0, M], N and M are integers, and N>=2.

B: regarding x' as the grey scale value of the previous-frame image and y' as the grey scale value of the current-frame image when the LCD panel is driven, finding out an effective OD value (x', y') from the OD table. If x' is equal to XN*a, and y' is equal to XN*b, the effective OD value (x', y') is directly found out from the OD table. If x' is not equal to XN*a, and y' is not equal to XN*b, a three-dimensional coordinate system is set according to coordinate axis of x', y', and the OD value (x', y'). The OD value (x', y') is fitted to a continuous two-dimensional surface by reference to the OD value (XN*a, XN*b) in the OD table, and the OD value (x', y') is correspondingly calculated according to function of the two-dimensional surface fitted.

C: outputting the OD value (x', y') to the LCD panel after the previous-frame image is output but before the current frame image is output.

A method for establishing the function of the two-dimensional surface as follows:

The two-dimensional surface is divided into M*M sub-surfaces, and first derivatives of junctional areas of all sub-surfaces are continuous. The function of the two-dimensional surface fitted in the step B is formed by a sub-surface equation corresponding to each of the sub-surfaces.

The sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \tag{1}$$

A boundary condition corresponding to each of the sub-surfaces is:

$$OD(0,0)=C_h \tag{2}$$

$$OD(0,N)=C_i \tag{3}$$

$$OD(N,0)=C_j \tag{4}$$

$$OD(N,N)=C_k \tag{5}$$

$$\frac{dOD(0,0)}{dx}=\frac{C_i-C_h}{16} \tag{6}$$

$$\frac{dOD(0,0)}{dy}=\frac{C_j-C_h}{16} \tag{7}$$

-continued $$\frac{dOD(0,16)}{dx}=\begin{cases}0, & \text{The sub-surface lies in a right boundary of the two-dimensional surface}\\ \frac{C_1-C_i}{16}, & \text{The sub-surface does not lie in a boundary of the two-dimensional surface}\end{cases} \quad (8)$$

$$\frac{dOD(0,16)}{dy}=\frac{C_k-C_i}{16} \quad (9)$$

$$\frac{dOD(16,0)}{dx}=\frac{C_k-C_j}{16} \quad (10)$$

$$\frac{dOD(16,0)}{dy}=\begin{cases}0, & \text{The sub-surface lies in an upper boundary of the two-dimensional surface}\\ \frac{C_m-C_k}{16}, & \text{The sub-surface does not lie in the boundary of the two-dimensional surface}\end{cases} \quad (11)$$

In the above-mentioned equation:

1) x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface.

2) A, B, C, D, E, F, G, H, I, and J are constant parameters of each of the surfaces, where each of the constant parameters is calculated according to the boundary condition of the corresponding sub-surface.

3) Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right.

If a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

According to the above-mentioned function of the two-dimensional surface, the step B of the present disclosure is divided into following steps:

B1-1: reading the grey scale value x' of the previous-frame image and the grey scale value y' of the current-frame image;

B1-2: looking up a grey scale coordinate (x, y) of the grey scale value x' and the grey scale value y' that correspond to the sub-surface;

B1-3: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table; and B1-4: calculating the OD value (x, y) according to the equations of (1)-(11);

where x'=x+N*a, y'=y+N*b, a and b∈[0, M].

The first example provides a specific function of the two-dimensional surface. The two-dimensional surface is divided into a plurality of sub-surfaces, and the first derivatives of junctional areas of all sub-surfaces is continuous. Thus, as long as the grey scale value x' of the previous-frame image and the grey scale value y' of the current-frame image are read, and the grey scale coordinate (x, y) of the grey scale value x' and the grey scale value y' that correspond to the sub-surface are found out, the OD value (x', y') can be calculated according to the equation of the sub-surface and the boundary condition of the sub-surface. The OD value (x', y') accurately corresponds to the grey scale value (x', y'). The driving circuit only stores the OD value corresponding to the boundary of each of the sub-surfaces and does not store the OD value corresponding to each of the sub-surfaces, which lowers storage space requirements and decreases component costs.

Example 2

Figure 4:
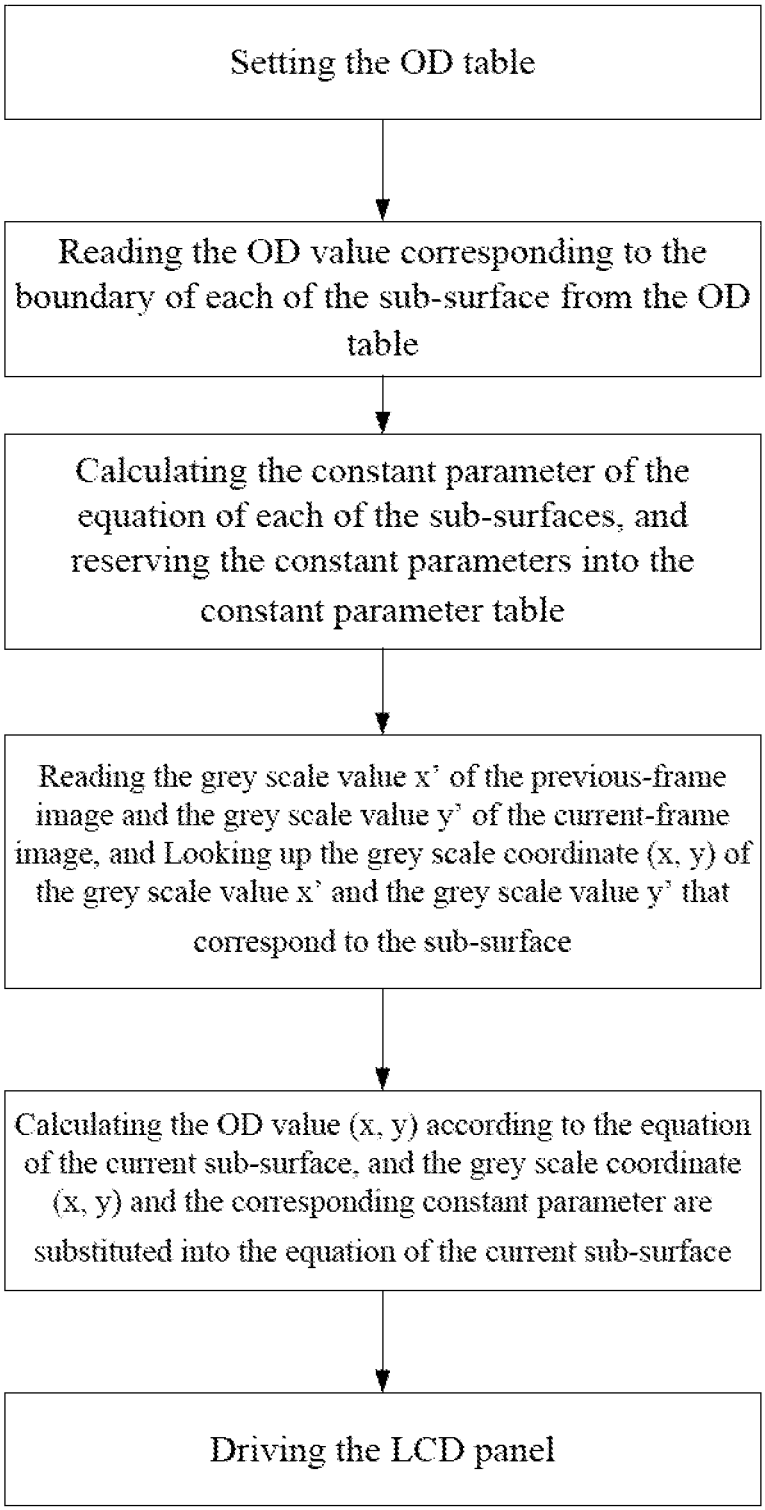
FIG. 4 is a flowchart of a method for driving a liquid crystal display (LCD) of a second example of the present disclosure.

As shown in FIG. 4, a function of a two-dimensional surface of a second example is same as the function of the two-dimensional surface of the first example, a difference between the second example and the first example is the step B, the step B of the second example is divided into flowing steps:

B2-1: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table.

B2-2: calculating the constant parameter of the equation (1) of each of the sub-surfaces by substituting the OD value Ch, Ci, Cj, Ck, Cl, and Cm into the equation (2)-(11) of the boundary condition of each of the sub-surfaces, and storing the constant parameters into a constant parameter table.

B2-3: reading the grey scale value x' of the previous-frame image and the grey scale value y' of the current-frame image, and looking up the grey scale coordinate (x, y) of the grey scale value x' and the grey scale value y' that correspond to the sub-surface.

B2-4: calculating the OD value (x, y) according to the equations of (1) of the current sub-surface, where the grey scale coordinate (x, y) and the corresponding constant parameter are substituted into the equation (1), where x'=x+N*a, y'=y+N*b, and a and b∈[0, M].

In the second example, the constant parameter of the equation of each of the sub-surfaces is calculated in advance and stored in the driving circuit, when the LCD panel is driven, as long as the equation of the sub-surface corresponding to the grey scale value can be determined, the OD value (x', y') can be calculated by directly substituting the grey scale coordinate (x, y) into the equation of the sub-surface, which avoids calculation of the constant parameter, thereby improving response speed of the driving circuit and improves display quality of the LCD panel.

Example 3

Figure 5:
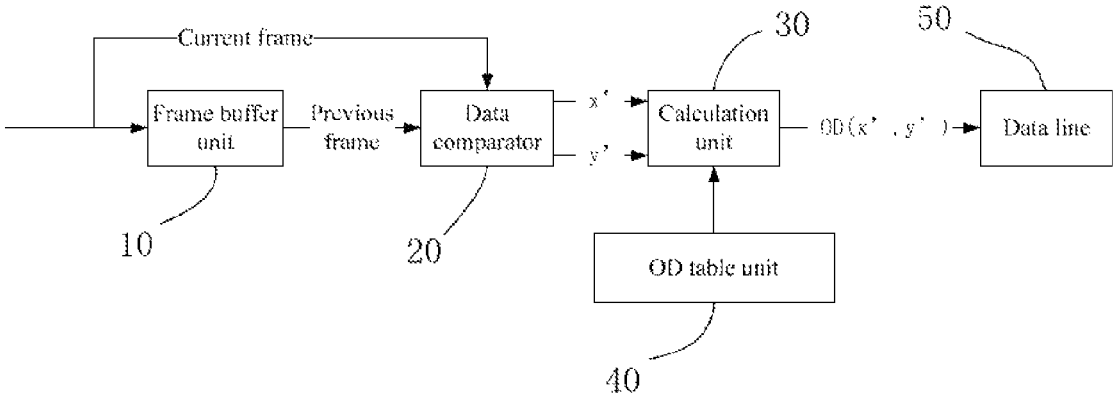
FIG. 5 is a schematic diagram of a driving circuit of a liquid crystal display (LCD) panel excluding a parameter unit of a third example of the present disclosure.
Figure 6:
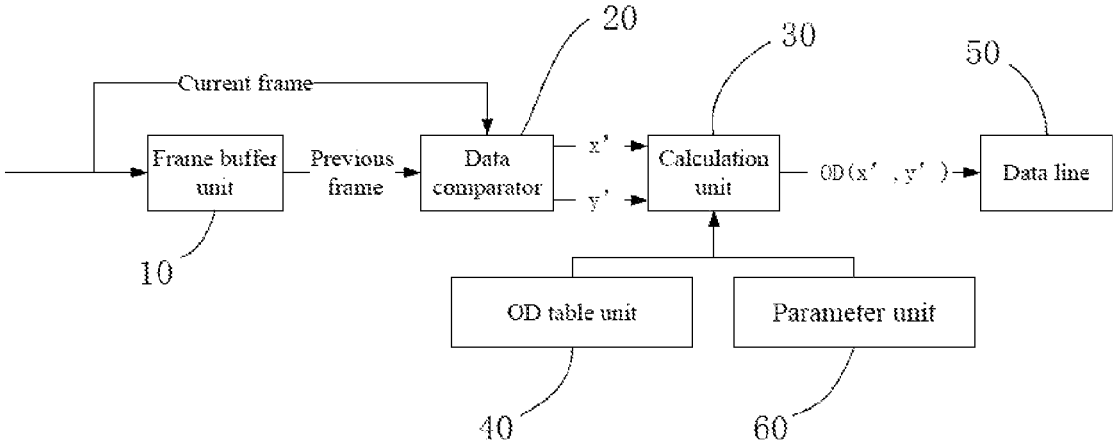
FIG. 6 is a schematic diagram of a driving circuit of a liquid crystal display (LCD) panel including a parameter unit of a third example of the present disclosure.

As shown in FIG. 5 and FIG. 6, a third example provides a liquid crystal display (LCD) device comprising a LCD panel and a driving circuit of the LCD panel. The LCD panel comprises a plurality of data lines 50 coupled to the driving circuit of the LCD panel.

The driving circuit of the LCD panel comprises a frame buffer unit 10 storing a previous-frame image, an over drive (OD) table unit 40 storing an M*M OD table set through regarding N grey scales as one unit, and a calculation unit 30 coupled to the OD table unit 40.

The M*M OD table comprises a grey scale value XN*a of the previous-frame image, a grey scale value XN*b of a current-frame image, and an OD value (XN*a, XN*b) corresponding to the grey scale value XN*a and the grey scale value XN*b, where a and b∈[0, M], N and M are integers, and N>=2.

A grey scale value y' of the current-frame image and a grey scale value x' of the previous-frame image stored in the frame buffer unit 10 are sent to the calculation unit 30, the calculation unit 30 finds out an effective OD value (x', y') from the OD table, and the effective OD value (x', y') is output to a corresponding data line 50 of the LCD panel.

If x' is equal to XN*a, and y' is equal to XN*b, the effective OD value (x', y') is directly found out from the OD table. If x' is not equal to XN*a, and y' is not equal to XN*b, a three-dimensional coordinate system is established according to coordinate axis of x', y', and the OD value (x', y'). The OD value (x', y') is fitted to a continuous two-dimensional surface by reference to the OD value (XN*a, XN*b) in the OD table, and the OD value (x', y') is correspondingly calculated according to function of the two-dimensional surface fitted.

The calculation unit 30 comprises a surface generating unit, a limited unit storing a boundary condition of each of the sub-surfaces, and an arithmetic unit obtaining the OD value (x', y') by calculating the equation of each of the sub-surfaces. The surface generating unit divides the two-dimensional surface into M*M sub-surfaces, and allows first derivatives of junctional areas of all sub-surfaces to be continuous.

The sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \tag{1}$$

The boundary condition corresponding to each of the sub-surfaces is:

$$OD(0,0)=C_h \tag{2}$$

$$OD(0,N)=C_i \tag{3}$$

$$OD(N,0)=C_j \tag{4}$$

$$OD(N,N)=C_k \tag{5}$$

$$\frac{dOD(0,0)}{dx}=\frac{C_i-C_h}{16} \tag{6}$$

$$\frac{dOD(0,0)}{dy}=\frac{C_j-C_h}{16} \tag{7}$$

$$\frac{dOD(0,16)}{dx}=\begin{cases}0, & \text{The sub-surface lies in a right boundary of the two-dimensional surface}\\ \frac{C_1-C_i}{16}, & \text{The sub-surface does not lie in a boundary of the two-dimensional surface}\end{cases} \tag{8}$$

-continued $$\frac{dOD(0,16)}{dy}=\frac{C_k-C_i}{16} \tag{9}$$

$$\frac{dOD(16,0)}{dx}=\frac{C_k-C_j}{16} \tag{10}$$

$$\frac{dOD(16,0)}{dy}=\begin{cases}0, & \text{The sub-surface lies in an upper boundary of the two-dimensional surface}\\ \frac{C_m-C_k}{16}, & \text{The sub-surface does not lie in the boundary of the two-dimensional surface}\end{cases} \tag{11}$$

In the above-mentioned equation:

1) x is the grey scale value of the previous-frame image corresponding to the sub-surface, y is the grey scale value of the current-frame image corresponding to the sub-surface, x' is the grey scale value of the previous-frame image corresponding to an entire two-dimensional surface, and y' is the grey scale value of the current-frame image corresponding to the entire two-dimensional surface.

2) A, B, C, D, E, F, G, H, I, and J are constant parameters of each of the surfaces, where each of the constant parameters is calculated according to the boundary condition of the corresponding sub-surface.

3) Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right.

If a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

The example provides a specific function of the two-dimensional surface. The two-dimensional surface is divided into a plurality of sub-surfaces, and the first derivatives of junctional areas of all sub-surfaces is continuous. Thus, the grey scale value x' of the previous-frame image and the grey scale value y' of the current-frame image are read, and the grey scale coordinate (x, y) of the grey scale value x' and the grey scale value y' that correspond to the sub-surface are found out, the OD value (x', y') can be calculated according to the equation of the sub-surface and the boundary condition of the sub-surface. The OD value (x', y') accurately corresponds to the grey scale value (x', y'). The driving circuit only stores the OD value corresponding to the boundary of each of the sub-surfaces and does not store the OD value corresponding to each of the sub-surfaces, which lowers storage space requirements and decreases component costs.

The driving circuit of the LCD panel also uses a data comparator 20, where the frame buffer unit 10 is coupled to the calculation unit 30 through the data comparator 20, and the grey scale value x' of the previous-frame image and the grey scale value y' of the current-frame image are sent to the calculation unit 30 by the data comparator 20. In the present disclosure, the data comparator 20 is used to extract the grey scale values of the previous-frame image and the current-frame image, and send the grey scale values of the previous-frame image and the current-frame image to the calculation unit 30, the calculation unit 30 directly reads the grey scale values and substitutes the grey scale values into the equation of the sub-face, which improves arithmetic speed of the calculation unit 30.

The driving circuit of the LCD panel also uses a parameter unit 60, where the parameter unit 60 is coupled to the calculation unit 30, and stores a constant parameter table of the equation of each of the sub-surfaces. Thus, the constant parameter of the equation of each of the sub-surfaces is calculated in advance and stored in the driving circuit, when the LCD panel is driven, as long as the equation of the sub-surface corresponding to the grey scale value can be determined, the OD value (x', y') can be calculated by directly substituting the grey scale coordinate (x, y) into the equation of the sub-surface, which avoids calculation of the constant parameter, thereby improving response speed of the driving circuit and improves display quality of the LCD panel.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A method for driving a liquid crystal display (LCD) panel, comprising:

A: setting an M*M over drive (OD) table by regarding N grey scales as one unit, the M*M OD table comprises a grey scale value XN*a of a previous-frame image, a grey scale value XN*b of a current-frame image, and an OD value (XN*a, XN*b) corresponding to the grey scale value XN*a and the grey scale value XN*b, wherein a and b∈[0, M], N and M are integers, and N>=2;

B: regarding x' as the grey scale value of the previous-frame image and y' as the grey scale value of the current-frame image when the LCD panel is driven, finding out an effective OD value (x', y') from the OD table; if x' is equal to XN*a, and y' is equal to XN*b, the effective OD value (x', y') is directly found out from the OD table; if x' is not equal to XN*a, and y' is not equal to XN*b, a three-dimensional coordinate system is set according to coordinate axis of x', y', and the OD value (x', y'); the OD value (x', y') is fitted to a continuous two-dimensional surface by reference to the OD value (XN*a, XN*b) in the OD table, and the OD value (x', y') is correspondingly calculated according to function of the two-dimensional surface fitted; and C: outputting the OD value (x', y') to the LCD panel after the previous-frame image is output but before the current frame image is output.

2. The method for driving the LCD panel of claim 1, wherein M is equal to 17, and N is equal to 16.

3. The method for driving the LCD panel of claim 1, wherein two-dimensional surface in the step B is divided into M*M sub-surfaces, and first derivatives of junctional areas of all sub-surfaces are continuous; the function of the two-dimensional surface fitted in the step B is formed by a sub-surface equation corresponding to each of the sub-surfaces; the sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \quad (1)$$

a boundary condition corresponding to each of the sub-surfaces is:

$$OD(0,0)=C_h \quad (2)$$

$$OD(0,N)=C_i \quad (3)$$

$$OD(N,0)=C_j \quad (4)$$

$$OD(N,N)=C_k \quad (5)$$

$$\frac{dOD(0,0)}{dx}=\frac{C_i-C_h}{16} \quad (6)$$

$$\frac{dOD(0,0)}{dy}=\frac{C_j-C_h}{16} \quad (7)$$

when the sub-surface lies in an upper boundary of the-dimensional surface, $$\frac{dOD(0,16)}{dx}=0 \quad (8a)$$

when the sub-surface does not lie in an upper boundary of the-dimensional surface $$\frac{dOD(0,16)}{dx}=\frac{C_1-C_i}{16}, \quad (8b)$$

$$\frac{dOD(0,16)}{dy}=\frac{C_k-C_i}{16} \quad (9)$$

$$\frac{dOD(16,0)}{dx}=\frac{C_k-C_j}{16} \quad (10)$$

when the sub-surface lies in an upper boundary of the-dimensional surface, $$\frac{dOD(16,0)}{dy}=0 \quad (11a)$$

when the sub-surface does not lie in an upper boundary of the-dimensional surface $$\frac{dOD(16,0)}{dy}=\frac{C_m-C_k}{16}, \quad (11b)$$

x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface;

A, B, C, D, E, F, G, H, I, and J are constant parameters of each of the surfaces, wherein each of the constant parameters is calculated according to the boundary condition of the corresponding sub-surface;

Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right;

if a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

4. The method for driving the LCD panel of claim 3, wherein M is equal to 17, and N is equal to 16.

5. The method for driving the LCD panel of claim 3, wherein the step B comprises:

B1-1: reading the grey scale value x' of the previous-frame image and the grey scale value y' of the current-frame image;

B1-2: looking up a grey scale coordinate (x, y) of the grey scale value x' and the grey scale value y' that correspond to the sub-surface;

B1-3: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table; and B1-4: calculating the OD value (x, y) according to the equations of (1)-(11);

wherein, x'=x+N*a, y'=y+N*b, and a and b∈[0, M].

6. The method for driving the LCD panel of claim 5, wherein M is equal to 17, and N is equal to 16.

7. The method for driving the LCD panel of claim 3, wherein the step B comprises:

B2-1: reading the OD value Ch corresponding to the left-lower boundary of the sub-surface, the OD value Ci corresponding to the right-lower boundary of the sub-surface, the OD value Cj corresponding to the left-upper boundary of the sub-surface, the OD value Ck corresponding to the right-upper boundary of the sub-surface, the OD value Cl corresponding to the left-lower boundary of the adjacent sub-surface on the right, and the OD value Cm corresponding to the left-upper boundary of the adjacent sub-surface on the right from the OD table;

B2-2: calculating the constant parameter of the equation (1) of each of the sub-surfaces by substituting the OD value Ch, Ci, Cj, Ck, Cl, and Cm into the equation (2)-(11) of the boundary condition of each of the sub-surfaces, and storing the constant parameters into a constant parameter table;

B2-3: reading the grey scale value x' of the previous-frame image and the grey scale value y' of the current-frame image, and looking up the grey scale coordinate (x, y) of the grey scale value x' and the grey scale value y' that correspond to the sub-surface; and B2-4: calculating the OD value (x, y) according to the equations of (1) of the current sub-surface, wherein the grey scale coordinate (x, y) and the corresponding constant parameter are substituted into the equation (1);

wherein x'=x+N*a, y'=y+N*b, and a and b∈[0, M].

8. The method for driving the LCD panel of claim 7, wherein M is equal to 17, and N is equal to 16.

9. A driving circuit of a liquid crystal display (LCD) panel, comprising:

a frame buffer unit storing a previous-frame image;

an over drive (OD) table unit storing an M*M OD table; and a calculation unit coupled to the OD table unit;

wherein the M*M OD table is set by regarding N grey scales as one unit and comprises a grey scale value XN*a of the previous-frame image, a grey scale value XN*b of a current-frame image, and an OD value (XN*a, XN*b) corresponding to the grey scale value XN*a and the grey scale value XN*b; wherein a and b∈[0, M], N and M are integers, and N>=2;

a grey scale value y' of the current-frame image and a grey scale value x' of the previous-frame image stored in the frame buffer unit are sent to the calculation unit, the calculation unit finds out an effective OD value (x', y') from the OD table, then the effective OD value (x', y') is output to a corresponding data line of the LCD panel;

if x' is equal to XN*a, and y' is equal to XN*b, the effective OD value (x', y') is directly found out from the OD table;

if x' is not equal to XN*a, and y' is not equal to XN*b, a three-dimensional coordinate system is established according to coordinate axis of x', y', and the OD value (x', y'); the OD value (x', y') is fitted to a continuous two-dimensional surface by reference to the OD value (XN*a, XN*b) in the OD table, and the OD value (x', y') is correspondingly calculated according to function of the two-dimensional surface fitted.

10. The driving circuit of the LCD panel of claim 9, further comprising a data comparator; the frame buffer unit is coupled to the calculation unit through the data comparator, and the grey scale value x' of the previous-frame image and the grey scale value y' of the current-frame image are sent to the calculation unit by the data comparator.

11. The driving circuit of the LCD panel of claim 9, wherein the calculation unit comprises a surface generating unit, a limited unit storing a boundary condition of each of the sub-surfaces, and an arithmetic unit obtaining the OD value (x', y') by calculating the equation of each of the sub-surfaces; wherein the surface generating unit divides the two-dimensional surface into M*M sub-surfaces, and allows first derivatives of junctional areas of all sub-surfaces to be continuous;

the sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \quad (1)$$

the boundary condition corresponding to each of the sub-surfaces is:

$$OD(0,0)=C_h \quad (2)$$

$$OD(0,N)=C_i \quad (3)$$

$$OD(N,0)=C_j \quad (4)$$

$$OD(N,N)=C_k \quad (5)$$

$$\frac{dOD(0,0)}{dx}=\frac{C_i-C_h}{16} \quad (6)$$

$$\frac{dOD(0,0)}{dy}=\frac{C_j-C_h}{16} \quad (7)$$

when the sub-surface lies in an upper boundary of the-dimensional surface, $$\frac{dOD(0,16)}{dx}=0 \tag{8a}$$

When the sub-surface does not lie in an upper boundary of the-dimensional surface $$\frac{dOD(0,16)}{dx}=\frac{C_1-C_i}{16}, \tag{8b}$$

$$\frac{dOD(0,16)}{dy}=\frac{C_k-C_i}{16} \tag{9}$$

$$\frac{dOD(16,0)}{dx}=\frac{C_k-C_j}{16} \tag{10}$$

when the sub-surface lies in an upper boundary of the-dimensional surface, $$\frac{dOD(16,0)}{dy}=0 \tag{11a}$$

when the sub-surface does not lie in an upper boundary of the-dimensional surface $$\frac{dOD(16,0)}{dy}=\frac{C_m-C_k}{16}, \tag{11b}$$

x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface;

A, B, C, D, E, F, G, H, I, and J are constant parameters of each of the surfaces, wherein each of the constant parameters is calculated according to the boundary condition of the corresponding sub-surface;

Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right;

if a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

12. The driving circuit of the LCD panel of claim 11, further comprising a data comparator; the frame buffer unit is coupled to the calculation unit through the data comparator, and the grey scale value x' of the previous-frame image and the grey scale value y' of the current-frame image are sent to the calculation unit by the data comparator.

13. The driving circuit of the LCD panel of claim 11, further comprising a parameter unit, wherein the parameter unit is coupled to the calculation unit, and stores a constant parameter table of the equation of each of the sub-surfaces.

14. The driving circuit of the LCD panel of claim 13, further comprising a data comparator; the frame buffer unit is coupled to the calculation unit through the data comparator, and the grey scale value x' of the previous-frame image and the grey scale value y' of the current-frame image are sent to the calculation unit by the data comparator.

15. A liquid crystal display (LCD) device, comprising:

an LCD panel;

wherein the LCD panel comprises a plurality of data lines coupled to a driving circuit of the LCD panel; the driving circuit of the LCD panel comprises a frame buffer unit storing a previous-frame image, an over drive (OD) table unit storing an M*M OD table, and a calculation unit coupled to the OD table unit;

the M*M OD table the M*M OD table is set by regarding N grey scales as one unit and comprises a grey scale value XN*a of the previous-frame image, a grey scale value XN*b of a current-frame image, and an OD value (XN*a, XN*b) corresponding to the grey scale value XN*a and the grey scale value XN*b; a and b∈[0, M], N and M are integers, and N>=2;

a grey scale value y' of the current-frame image and a grey scale value x' of the previous-frame image stored in the frame buffer unit are sent to the calculation unit, the calculation unit finds out an effective OD value (x', y') from the OD table, then the effective OD value (x', y') is output to a corresponding data line of the LCD panel;

if x' is equal to XN*a, and y' is equal to XN*b, the effective OD value (x', y') is directly found out from the OD table;

if x' is not equal to XN*a, and y' is not equal to XN*b, a three-dimensional coordinate system is set according to coordinate axis of x', y', and the OD value (x', y'); the OD value (x', y') is fitted to a continuous two-dimensional surface by reference to the OD value (XN*a, XN*b) in the OD table, and the OD value (x', y') is correspondingly calculated according to function of the two-dimensional surface fitted.

16. The LCD device of claim 15, wherein the driving circuit of the LCD panel further comprises a data comparator; the frame buffer unit is coupled to the calculation unit through the data comparator, and the grey scale value x' of the previous-frame image and the grey scale value y' of the current-frame image are sent to the calculation unit by the data comparator.

17. The LCD device of claim 15, wherein the calculation unit comprises a surface generating unit, a limited unit storing a boundary condition of each of the sub-surfaces, and an arithmetic unit obtaining the OD value (x', y') by calculating the equation of each of the sub-surfaces; wherein the surface generating unit divides the two-dimensional surface into M*M sub-surfaces, and allows first derivatives of junctional areas of all sub-surfaces to be continuous;

the sub-surface equation corresponding to each of the sub-surfaces is:

$$OD(x,y)=A+Bx+Cy+Dxy+Ex^2+Fy^2+Gx^2y+Hxy^2+Ix^3+Jy^3,\ x\in[0,N),\ y\in[0,N) \tag{1}$$

the boundary condition corresponding to each of the sub-surfaces is:

$$OD(0,0)=C_h \tag{2}$$

$$OD(0,N)=C_i \tag{3}$$

-continued $$OD(N, 0) = C_j \tag{4}$$

$$OD(N, N) = C_k \tag{5}$$

$$\frac{dOD(0, 0)}{dx} = \frac{C_i - C_h}{16} \tag{6}$$

$$\frac{dOD(0, 0)}{dy} = \frac{C_j - C_h}{16} \tag{7}$$

when the sub-surface lies in an upper boundary of the-dimensional surface, $$\frac{dOD(0, 16)}{dx} = 0 \tag{8a}$$

when the sub-surface does not lie in an upper boundary of the-dimensional surface $$\frac{dOD(0, 16)}{dx} = \frac{C_1 - C_i}{16}, \tag{8b}$$

$$\frac{dOD(0, 16)}{dy} = \frac{C_k - C_i}{16} \tag{9}$$

$$\frac{dOD(16, 0)}{dx} = \frac{C_k - C_j}{16} \tag{10}$$

when the sub-surface lies in an upper boundary of the-dimensional surface, $$\frac{dOD(16, 0)}{dy} = 0 \tag{11a}$$

when the sub-surface does not lie in an upper boundary of the-dimensional surface $$\frac{dOD(16, 0)}{dy} = \frac{C_m - C_k}{16}, \tag{11b}$$

x is a grey scale value of the previous-frame image corresponding to the sub-surface, y is a grey scale value of the current-frame image corresponding to the sub-surface, x' is a grey scale value of the previous-frame image corresponding to an entire two-dimensional surface, and y' is a grey scale value of the current-frame image corresponding to the entire two-dimensional surface;

A, B, C, D, E, F, G, H, I, and J are constant parameters of each of the surfaces, wherein each of the constant parameters is calculated according to the boundary condition of the corresponding sub-surface;

Ch is an OD value corresponding to a left-lower boundary of the sub-surface, Ci is an OD value corresponding to a right-lower boundary of the sub-surface, Cj is an OD value corresponding to a left-upper boundary of the sub-surface, Ck is an OD value corresponding to a right-upper boundary of the sub-surface, Cl is an OD value corresponding to a left-lower boundary of an adjacent sub-surface on the right, Cm is an OD value corresponding to a left-upper boundary of the adjacent sub-surface on the right;

if a grey scale value of a current sub-surface lies in coordinate (x+N*a, y+N*b) of the entire two-dimensional surface, a grey scale value of the adjacent sub-surface on the right lies in coordinate (x+N*(a+1), y+N*b) of the entire two-dimensional surface.

18. The LCD device of claim 17, the driving circuit of the LCD panel further comprises a data comparator; the frame buffer unit is coupled to the calculation unit through the data comparator, and the grey scale value x' of the previous-frame image and the grey scale value y' of the current-frame image are sent to the calculation unit by the data comparator.

19. The LCD device of claim 17, wherein the driving circuit of the LCD panel further comprises a parameter unit, the parameter unit is coupled to the calculation unit, and stores a constant parameter table of the equation of each of the sub-surfaces.

20. The LCD device of claim 19, wherein the driving circuit of the LCD panel further comprises a data comparator; the frame buffer unit is coupled to the calculation unit through the data comparator, and the grey scale value x' of the previous-frame image and the grey scale value y' of the current-frame image are sent to the calculation unit by the data comparator.

* * * * *